US012070133B2

(12) United States Patent
Abiose

(10) Patent No.: US 12,070,133 B2
(45) Date of Patent: Aug. 27, 2024

(54) C-SHAPED COCCYX, SACRUM, AND LUMBAR SEAT CUSHION

(71) Applicant: Olanrewaju Osauwense Abiose, Long Beach, CA (US)

(72) Inventor: Olanrewaju Osauwense Abiose, Long Beach, CA (US)

( * ) Notice: Subject to any disclaimer, the term of this patent is extended or adjusted under 35 U.S.C. 154(b) by 144 days.

(21) Appl. No.: 17/871,930

(22) Filed: Jul. 23, 2022

(65) Prior Publication Data

US 2022/0354258 A1 Nov. 10, 2022

Related U.S. Application Data

(63) Continuation-in-part of application No. 17/232,106, filed on Apr. 15, 2021, now abandoned.

(60) Provisional application No. 63/010,529, filed on Apr. 15, 2020.

(51) Int. Cl.
*A47C 7/02* (2006.01)
*A47C 7/18* (2006.01)

(52) U.S. Cl.
CPC ..... *A47C 7/029* (2018.08); *A47C 7/021* (2013.01); *A47C 7/18* (2013.01)

(58) Field of Classification Search
CPC ..... A47C 7/021; A47C 7/029; A47C 7/18
USPC ..... 297/219.1, 452.21, 452.22, 452.26, 297/452.27
See application file for complete search history.

(56) References Cited

U.S. PATENT DOCUMENTS 1,343,357 A * 6/1920 Eggers ..... A47C 27/081 5/655.3 X
1,468,072 A * 9/1923 Millas ..... A47C 27/081 128/DIG. 20
2,366,680 A * 1/1945 Valentine ..... A47C 7/021 297/452.22 X
3,050,748 A * 8/1962 Deutinger ..... A47K 3/125 5/644 X (Continued)

FOREIGN PATENT DOCUMENTS

DE 202012009651 U1 * 12/2012 ..... A47C 7/021
DE 202019005632 U1 * 5/2021 ..... A47C 7/021

(Continued)

*Primary Examiner* — Rodney B White
(74) *Attorney, Agent, or Firm* — Kevin M. Curran, Esq.; Curran Patent Law

(57) ABSTRACT

Apparatus, systems, and methods are disclosed involving a seat cushion configured as a partially-open annular ring, including a circular hollow space in a center of the ring, and a radial-arc-shaped opening in the ring forming a trapezium-shaped hollow space. The cushion includes a top section, a middle section, and a base section, in which the top and middle sections form the partially-open annular ring. Both the circular hollow space and the trapezium-shaped hollow space are located corresponding to the user's spine and coccyx, with the trapezium-shaped hollow space located on a rear portion of the cushion. The circular hollow space frees the perineal region from external compression by avoiding having any portion of the center of the seat cushion pressing against it, and the trapezium-shaped hollow space frees the sacrococcygeal region from external compression by not having any portion of partially-open annular ring of the seat cushion pressing against it.

20 Claims, 8 Drawing Sheets

(56) References Cited

U.S. PATENT DOCUMENTS 4,064,578 A * 12/1977 Yamada ..... A61G 5/1045 297/452.27 X
4,370,769 A * 2/1983 Herzig ..... A47C 7/021 297/452.41
4,824,174 A * 4/1989 Dunn, Sr. ..... A47C 7/024 297/452.22 X
4,930,171 A * 6/1990 Frantz ..... A61G 5/1043 5/653
4,960,304 A * 10/1990 Frantz ..... A61G 5/1043 297/452.21 X
5,269,590 A * 12/1993 Carilli ..... B60N 2/7035 297/216.1
5,294,181 A * 3/1994 Rose ..... A61G 5/1045 297/452.57
5,433,505 A * 7/1995 Coyne ..... A47C 9/005 297/452.21 X
5,465,441 A * 11/1995 Chun ..... A47C 7/021 5/653
5,855,415 A * 1/1999 Lilley, Jr. ..... A47C 7/021 297/452.27 X
6,241,320 B1 * 6/2001 Chew ..... A47C 7/021 297/452.26 X
6,820,938 B2 * 11/2004 Barrett ..... A47C 7/021 297/452.41
6,966,088 B1 * 11/2005 Hu ..... A61G 7/05784 5/944
7,344,196 B2 * 3/2008 Rodriquez ..... A47C 7/0213 5/653 X
8,321,979 B2 * 12/2012 Goodwin ..... A61G 7/05723 5/652
8,566,987 B1 * 10/2013 Burge ..... A47C 7/024 297/452.26 X
9,220,345 B2 * 12/2015 Davis ..... A47C 7/029
9,332,850 B2 * 5/2016 Krishtul ..... A47C 7/029
9,591,926 B2 * 3/2017 Harte ..... A47C 7/744
9,723,928 B2 * 8/2017 Krishtul ..... A47C 7/18
9,763,521 B2 * 9/2017 Krishtul ..... A47C 7/021
9,993,086 B2 * 6/2018 Harte ..... A47C 7/029
2002/0124318 A1 * 9/2002 Loomos ..... A47C 7/029 5/653
2004/0255385 A1 * 12/2004 England ..... A47C 27/16 5/655.9
2006/0185093 A1 * 8/2006 Yu ..... A47C 7/021 5/653
2007/0065625 A1 * 3/2007 Lai ..... B32B 7/12 428/68
2008/0216245 A1 * 9/2008 Liners ..... A47C 4/52 5/653
2012/0030878 A1 * 2/2012 Davenport ..... A61G 7/05776 5/655.3
2016/0113401 A1 * 4/2016 Covelli ..... A47C 7/142 297/452.48
2016/0174716 A1 * 6/2016 Covelli ..... A47C 7/14 297/250.1
2016/0353892 A1 * 12/2016 James ..... A47C 3/16
2018/0020837 A1 * 1/2018 Cheng ..... A47C 27/15 297/452.42
2020/0345152 A1 * 11/2020 Humble ..... A61G 7/057
2021/0046728 A1 * 2/2021 Bell ..... B32B 27/304

FOREIGN PATENT DOCUMENTS

EP 3738477 A1 * 11/2020 ..... A47C 27/084
GB 187064 A * 10/1922 ..... A47C 7/021
JP H0588365 U * 12/1993 ..... A47C 7/021

* cited by examiner

C-SHAPED COCCYX, SACRUM, AND LUMBAR SEAT CUSHION

CROSS REFERENCE TO RELATED APPLICATIONS

This application is related to, is a non-provisional application of, and claims the benefit of U.S. Provisional Patent Application Ser. No. 63/010,529 ("the '529 application"), filed 2020 Apr. 15, titled "C Shaped Coccyx, Sacrum, And Lumbar Cushion," which is incorporated by reference herein in its entirety for all purposes.

This application is related to, is a non-provisional Continuation-In-Part ("CIP") utility application of, and claims the benefit of U.S. Non-Provisional Utility patent application Ser. No. 17/232,106 ("the '106 application"), filed 2021 Apr. 15, titled "C-Shaped Coccyx, Sacrum, And Lumbar Seat Cushion," which is incorporated by reference herein in its entirety for all purposes.

BACKGROUND OF THE INVENTION

Embodiments of the present invention generally relate to apparatus, systems, and methods for cushioning a seat of a person who is subject to experiencing lower back pain when seated. More specifically, the present invention relates to apparatus, systems, and methods for preventing, reducing, and/or alleviating lower back pain of a seated person, comprising a seat cushion designed and adapted to reduce pressure applied to the seated person's sacrum and coccyx when the seated person's body weight presses down against a supporting surface on which the seated person is sitting.

A common problem for those who sit for a long period of time is lower back pain that is caused by the pressure applied to the nerves around the lumbar, sacral, and coccygeal vertebrae, or even the deformation of the disk of cartilage. In order to reduce the pressure applied to these parts of the spine, many people prefer to sit on seat cushions conventionally known in the prior art as "donut" cushions, i.e., cushions resembling a ring-shaped donut, in which a ring has an empty circular space within the ring. However, regular donut seat cushions conventionally known in the prior art only relieve pressure from a small portion of the perineum, and they still compress tissues and structures of the buttocks surrounding the perineum like the sacrum and coccyx. This traditional donut-style seat cushion is not an entirely satisfactory solution or way to release the pressure applied to the spine.

As described below, embodiments of the present invention include the use of novel features of a seat cushion having advantages and improvements over the conventional donut-style cushions, using apparatus, systems, and methods different from those of the prior art apparatus, systems, and methods. The present invention relates to a seat cushion for relief of pressure on the spine, especially for reducing pressure to the sacrum and coccyx, wherein the novel features include that the seat cushion is configured in the shape of a partial donut, in which the seat cushion is shaped as a partially open annular ring of cushion material.

BRIEF SUMMARY OF THE INVENTION

The invention relates to apparatus, systems, and methods involving a seat cushion made of resiliently deformable, resiliently flexible material such as sponge, soft foam, resilient fibers or resilient rubber and includes a circular hollow space and a trapezium hollow space. The circular hollow space frees the perineal region from external compression/anything pressing against it and the trapezium shaped hollow space frees the sacrococcygeal region from external compression/anything pressing against it. Both the circular hollow space and the trapezium shaped hollow space are located corresponding to the user's spine and coccyx.

In accordance with a first aspect of the invention, an apparatus is disclosed for reducing pressure applied to a sacrococcygeal region of a seated person, the apparatus comprising a seat cushion, adapted to avoid applying pressure to the sacrococcygeal region of the seated person; wherein the seat cushion comprises a partially-open annular ring of cushioning material that defines a hollow circular space in a center of the ring and a hollow space along a radial arc portion missing from a rear of the ring; wherein the hollow circular space connects to the hollow space along the radial arc portion of the ring; and, wherein the seat cushion is adapted to be positioned under the seated person with the hollow circular space underneath the seated person's perineum, and with the hollow space along the radial arc portion underneath the seated person's sacrococcygeal region.

In accordance with a second aspect of the invention, a system is disclosed for reducing pressure applied to a sacrococcygeal region of a seated person, in which the system includes, for instance: a supporting surface, adapted to support the seated person, the seated person having a body weight within a range of body weights for which the supporting surface is adapted; and a seat cushion, adapted to avoid applying pressure to the sacrococcygeal region of the seated person; wherein the seat cushion comprises a partially-open annular ring of cushioning material that defines a hollow circular space in a center of the ring and a hollow space along a radial arc portion missing from a rear of the ring; wherein the hollow circular space connects to the hollow space along the radial arc portion of the ring; and, wherein the seat cushion is adapted to be positioned under the seated person with the hollow circular space underneath the seated person's perineum, and with the hollow space along the radial arc portion underneath the seated person's sacrococcygeal region.

In accordance with a third aspect of the invention, a method for preventing, alleviating, and/or reducing pressure on a seated person's perineal region and sacrococcygeal region, and associated pain thereof, is disclosed, in which the method includes: providing a seat cushion, adapted to avoid applying pressure to the sacrococcygeal region of the seated person; positioning the seat cushion under the seated person to support and cushion the seated person's buttocks and groin, while avoiding applying pressure to the sacrococcygeal region of the seated person; and, using the seat cushion as positioned; wherein the seat cushion comprises a partially-open annular ring of cushioning material that defines a hollow circular space in a center of the ring and a hollow space along a radial arc portion missing from a rear of the ring; wherein the hollow circular space connects to the hollow space along the radial arc portion of the ring; and, wherein the seat cushion is adapted to be positioned under the seated person with the hollow circular space underneath the seated person's perineum, and with the hollow space along the radial arc portion underneath the seated person's sacrococcygeal region. The method further may include: providing a supporting surface, adapted to support the seated person, the seated person having a body weight within a range of body weights for which the supporting surface is adapted; and positioning the seat cushion on the supporting surface such that the seat cushion is positioned under the seated person to support and cushion the seated person's buttocks and groin, while avoiding applying pressure to the sacrococcygeal region of the seated person.

Further aspects of the invention are set forth herein. The details of exemplary embodiments of the invention are set forth in the accompanying drawings and the description below. Other features, objects, and advantages of the invention will be apparent from the description and drawings, and from the claims.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, the embodiments shown in the drawings are presently preferred. It should be understood, however, that the invention is not limited to the precise arrangements and instrumentalities shown. By reference to the appended drawings, which illustrate exemplary embodiments of this invention, the detailed description provided below explains in detail various features, advantages, and aspects of this invention. As such, features of this invention can be more clearly understood from the following detailed description considered in conjunction with the following drawings, in which the same reference numerals denote the same, similar, or comparable elements throughout. The exemplary embodiments illustrated in the drawings are not necessarily to scale or to shape and are not to be considered limiting of its scope, for the invention may admit to other equally effective embodiments having differing combinations of features, as set forth in the accompanying claims.

DETAILED DESCRIPTION OF THE INVENTION

Figure 1:
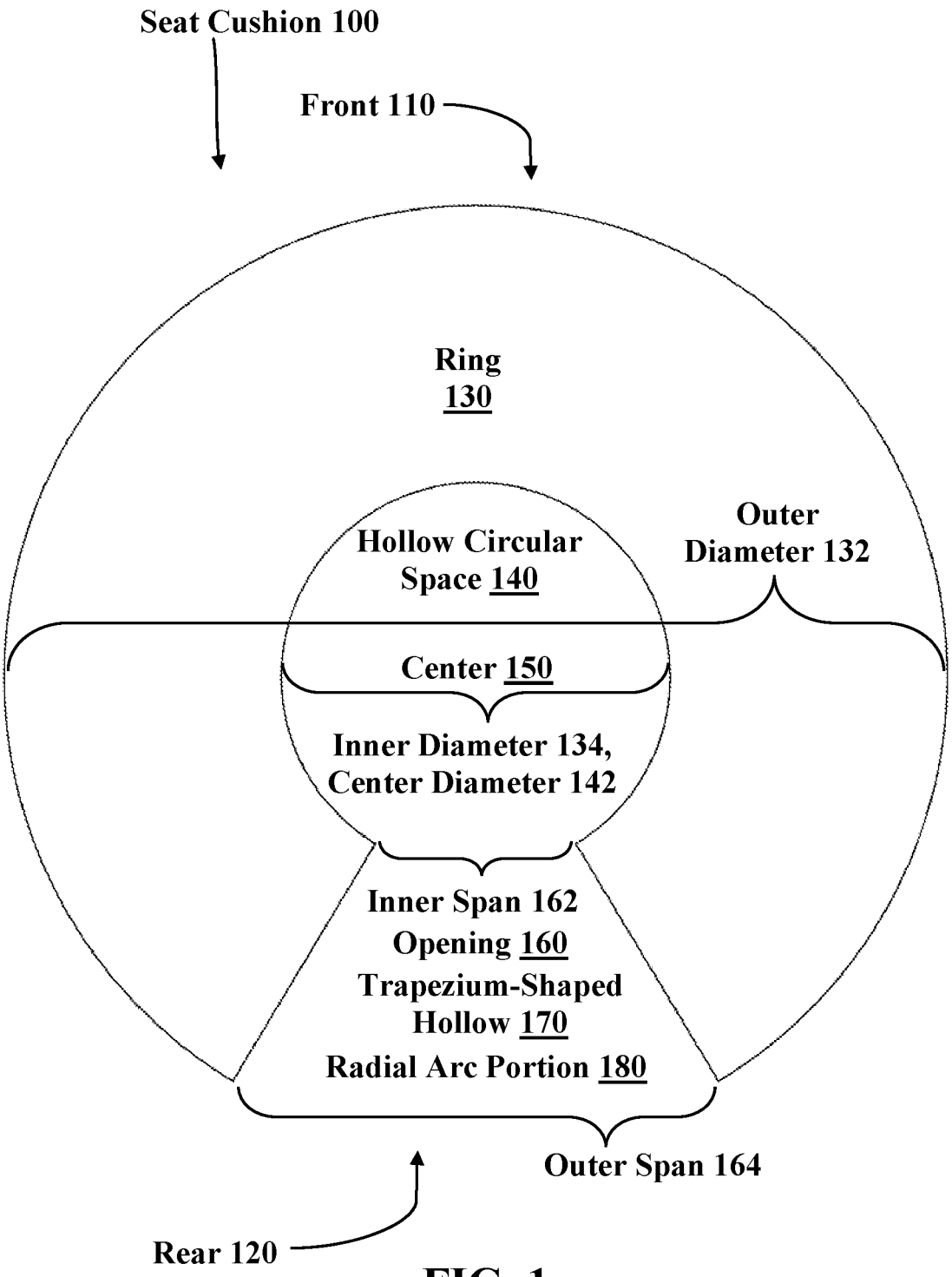
FIG. 1 depicts a plan view of a seat cushion, wherein a front of the seat cushion depicted above a rear of the seat cushion, in which the seat cushion is configured as a partially-open annular ring having a hollow circular space in a center of the ring, and having an opening in the ring forming a trapezium-shaped hollow, resembling a donut cushion missing a radial arc portion of the ring, in accordance with one embodiment of the present invention.

The invention is directed to systems, methods, and apparatus involving a seat cushion configured as a partially-open annular ring including a circular hollow space in a center of the ring, and a radial-arc-shaped opening in the ring forming a trapezium-shaped hollow space. The circular hollow space frees the perineal region from external compression by avoiding having any portion of the center of the seat cushion pressing against it, and the trapezium-shaped hollow space frees the sacrococcygeal region from external compression by not having any portion of partially-open annular ring of the seat cushion pressing against it. Both the circular hollow space and the trapezium-shaped hollow space are located corresponding to the user's spine and coccyx, with the trapezium-shaped hollow space located on a rear portion of the cushion. The seat cushion may be made of conventional materials used for cushioning, including resiliently deformable, resiliently flexible materials, such as sponge; synthetic soft foam, like polyurethane foam or "memory" foam; resilient fibers; or resilient rubber, or combinations thereof. The seat cushion may include a cloth or fabric cover or lining over the cushioning material, the cover or lining may be removable, replaceable, and/or washable for improved hygiene and extended useful lifespan. Similarly, the cushioning material may be removable, replaceable, and/or washable, depending on the choice of materials, design, and manufacturing process.

As depicted in the drawings described herein, a trapezium-shaped hollow space is depicted below a front portion of the seat cushion, leaving the rear portion of the seat cushion partially open and empty at a middle of the opening, which would be just below a seated person's spine who is sitting on the seat cushion. Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a fastener" may include a plurality of fasteners. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods, constructs, and materials are now described. All publications mentioned herein are incorporated herein by reference in their entirety. Where there are discrepancies in terms and definitions used in references that are incorporated by reference, the terms used in this application shall have the definitions given herein.

An advantage of the seat cushion of the present invention is the prevention of the seat cushion from applying pressure to the sacrococcygeal region when a seated person is sitting correctly on the seat cushion, such that the seated person's spine is centered above the trapezium-shaped hollow space.

Referring to the Figures, a seat cushion apparatus may include a round seat cushion that comprises a partially-open annular ring cushion body made of flexible material such as sponge, foam, resilient fibers, or resilient rubber, with a hollow circular space connected to a hollow space in the shape of a trapezium. A hollow circular space is created in the middle of the cushion and center of the ring. The hollow circular space is joined at the base to the hollow space in the shape of a trapezium. The round seat cushion may be positioned under a seated person using the cushion, so that the sacrum and coccyx of the user's spine will be above the trapezium-shaped hollow space and will not contact the round seat cushion, so that no reaction force is applied to the spine by the seat cushion. The circular hollow and trapezium shaped hollow respectively correspond to the locations of the perineum and the sacrococcygeal region.

Referring to FIG. 1, FIG. 1 depicts a plan view of a seat cushion 100, wherein a front 110 of the seat cushion 100 depicted above a rear 120 of the seat cushion 100, in which the seat cushion 100 is configured as a partially-open annular ring 130 having a hollow circular space 140 in a center 150 of the ring 130, and having an opening 160 in the ring 130 forming a trapezium-shaped hollow 170, resembling a donut cushion missing a radial arc portion 180 of the ring 130, in accordance with one embodiment of the present invention.

The ring 130 preferably may have, for example, an outer diameter 132 of about seventeen (17) inches an inner diameter 134 of about six (6) inches. The inner diameter 134 of ring 130 corresponds to a center diameter 142 of the hollow circular space 140. The opening 160 preferably may have, for example, an inner span 162 of four (4) inches, and an outer span 164 of about ten (10) inches, assuming that the trapezium-shaped hollow 170 preferably has, for example, a radial angle of about sixty (60) degrees, such that the missing radial arc portion 180 is about one sixth (⅙) of the annular ring 130, as measured if the annular ring 130 were complete and missing the radial arc portion 180. Although preferably shaped as a trapezium, as depicted, the opening 160 and hollow 170 may be formed to have other shapes, such as a rectangle. All of the above-mentioned preferred measurements are designed to accommodate a wide range of sizes of seated persons in a single-sized seat cushion. However, each measurement may range between a lower range value and a higher range value to configure seat cushions for smaller or larger seated persons. For example, each value may range from two (2) inches below and above the preferred value (e.g., an outer diameter 132 may range between 15 and 19 inches, with 17 inches being preferred, whereas the inner diameter 134 may range between 4 and 8 inches, with 6 inches being preferred).

Figure 2:
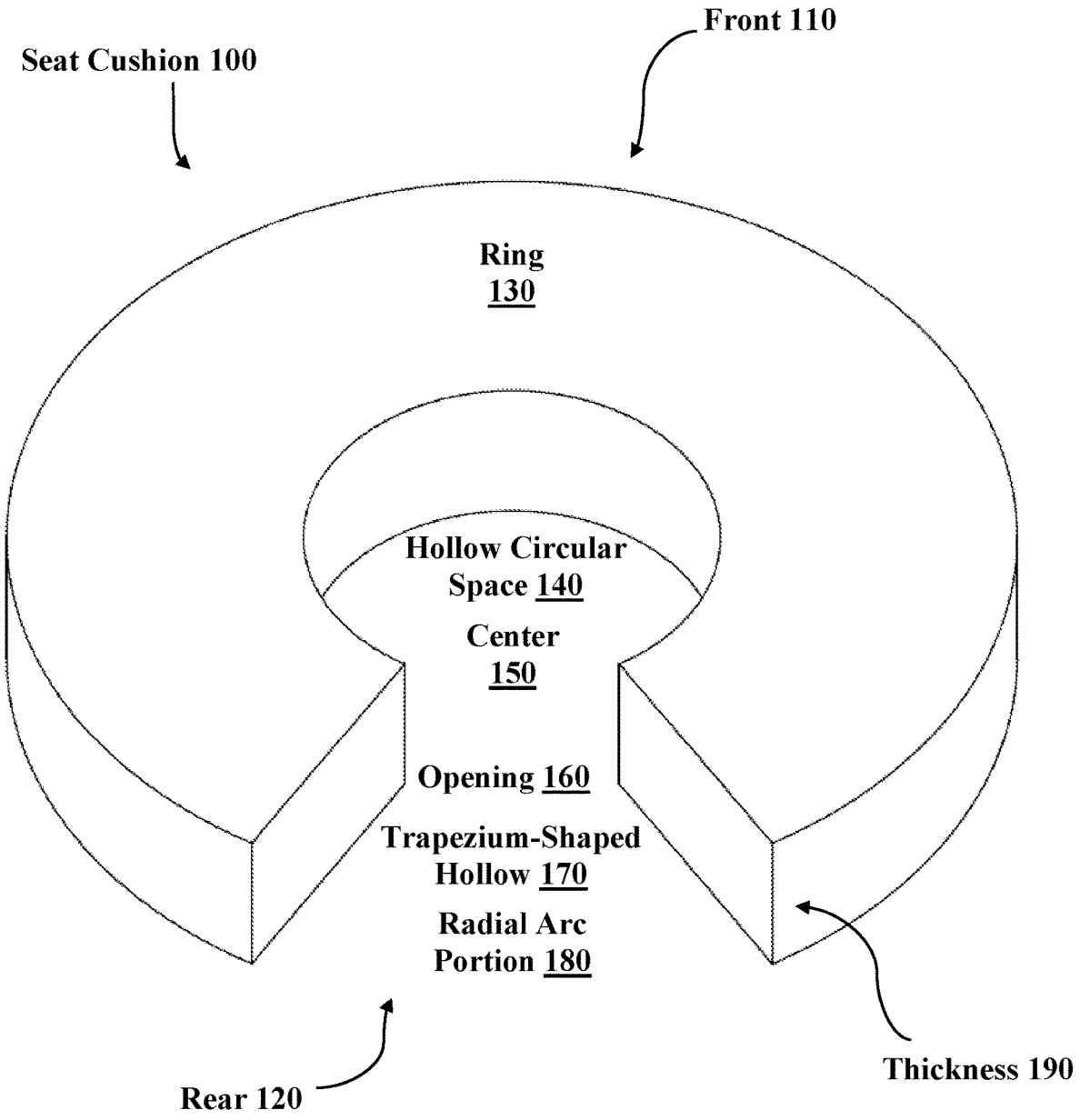
FIG. 2 depicts a rear perspective view of the seat cushion depicted in FIG. 1, with the opening of the trapezium-shaped hollow leading to the hollow circular space created in the center of the cushion, in accordance with one embodiment of the present invention.

Referring to FIG. 2, FIG. 2 depicts a depicts a rear perspective view of the seat cushion 100 depicted in FIG. 1, with the opening 160 of the trapezium-shaped hollow 170 leading to the hollow circular space 140 created in the center 150 of the cushion 100, in accordance with one embodiment of the present invention. A thickness 190 of the seat cushion 100 is variable depending on the environment, cushioning materials, and body weight envisioned for use of the seat cushion 100, and the thickness 190 preferably is several inches, to reduce the likelihood of the seat cushion 100 flattening completely, thereby allowing the seated person's sacrum and coccyx to contact the supporting surface below the seat cushion 100.

The depicted seat cushion may be used on top of most supporting surfaces that a seated person reasonably may be expected to be seated, such as a chair, bench, or pew. The supporting surface would be adapted to support the seated person, assuming the seated person has a body weight within a range that is typical of such persons, or the supporting surface is designed for a given range of body weights (e.g., a supporting surface designed for a child typically would not support the body weight of an adult). A supporting surface typically provides a strong, flat, stable, and hard surface environment for use of the seat cushion, but such an environment is only one example of a suitable environment and is not intended to suggest any limitation as to the scope of use or functionality. Numerous other environments or configurations may be used. Examples of well-known environments and/or configurations that may be suitable for use include, but are not limited to, chairs, couches, sofas, hospital beds, stools, benches, and environments that include any of the above devices, and the like.

Figure 3A:
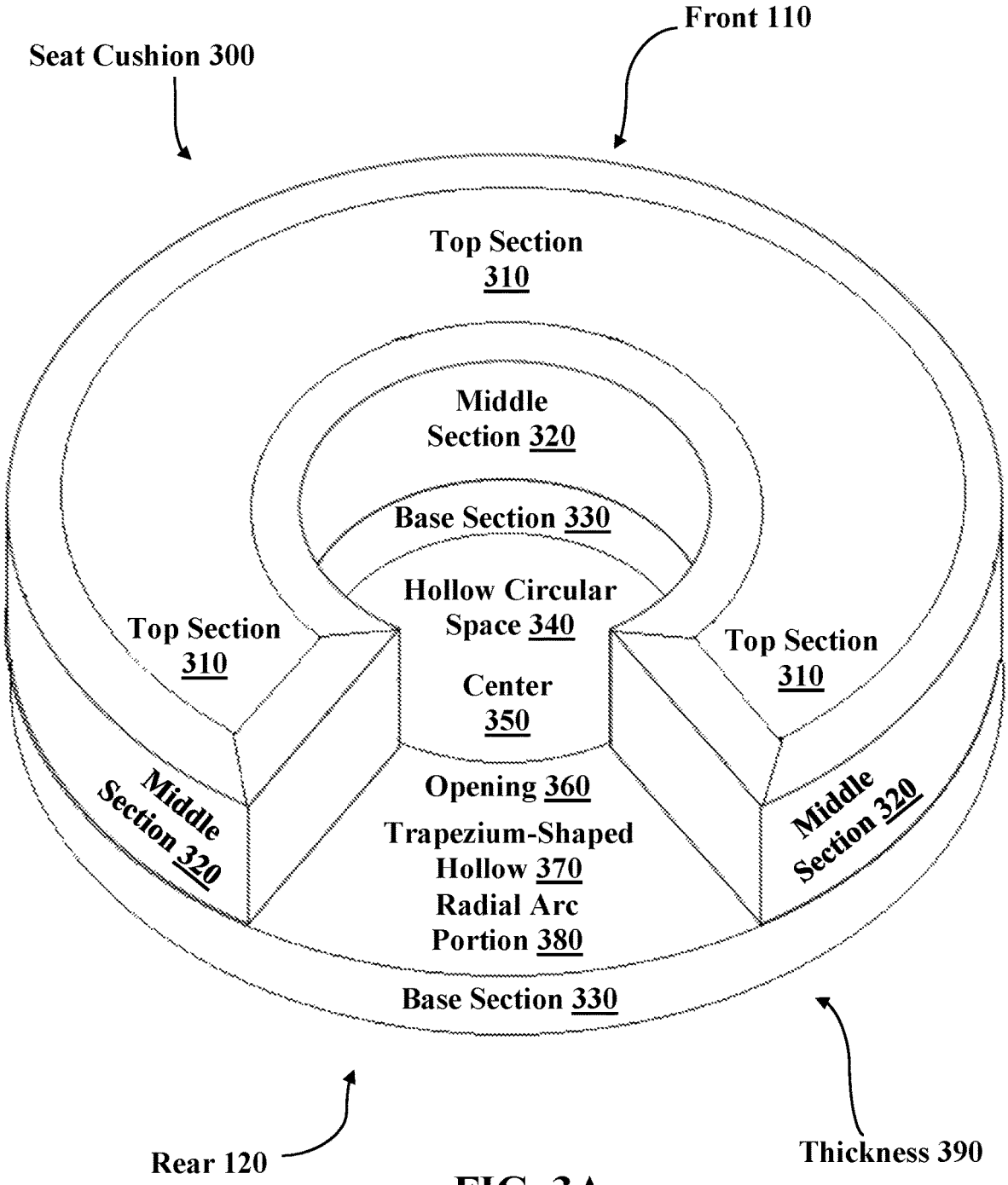
FIGS. 3A-3B depict top rear perspective views of a seat cushion, in accordance with exemplary embodiments of the present invention.

Referring to FIG. 3A, FIG. 3A depicts a top rear perspective view of a seat cushion 300. In an exemplary embodiment, when the cushion is placed on a flat surface, a top surface of the cushion 300 remains the same height at every point, without any slope. The cushion 300 comprises three layers, including an open annular partial ring top section 310, an open annular partial ring middle section 320, and a closed annular ring base section 330, each of which can be of varying thickness, firmness, density, and dimensions (e.g., length, height, and width). A strong adhesive may be used to glue and attach the base section 330 to the middle section 320 and the middle section 320 to the top section 310. The top section 310 of the cushion 300 has an open annular partial ring including a circular hollow space 340 in a center 350 of the partial ring, and a radial-arc-shaped opening 360 in the partial ring forming a trapezium-shaped hollow space 370 within a radial arc portion 380. The middle section 320 has an open annular partial ring including the circular hollow space 340 in the center 350 of the partial ring, and the radial-arc-shaped opening 360 in the partial ring forming the trapezium-shaped hollow space 370 within the radial arc portion 380. The base section 330 ring is closed and does not include a radial-arc-shaped opening in the ring forming a trapezium-shaped hollow space.

As depicted, base section 330 is a closed annular ring having the circular hollow space 340 in the center 350, but the circular hollow space 340 of the base section 330 could be omitted from the base section 330 to have the base section 330 form a disc rather than a ring.

The base section 330 supports the middle section 320 and the top section 310 and prevents lateral separation of the middle section 320 and the top section 310, together comprising an opening 360, to keep the openings of the opening 360 from increasing. Without the base section 330 being a closed ring, the radial-arc-shaped openings 360 forming the trapezium-shaped hollow space 370 may extend under pressure, and thereby fail to provide the relief of pressure to a user. Furthermore, without the base section 330 being a closed ring, the buttocks of a user will extend and expand the cushion hollow space 340 to a point where the buttocks will touch the chair or seat on which the cushion 300 is placed, rendering the cushion 300 unable to provide any relief or support the weight of the user.

Figure 3B:
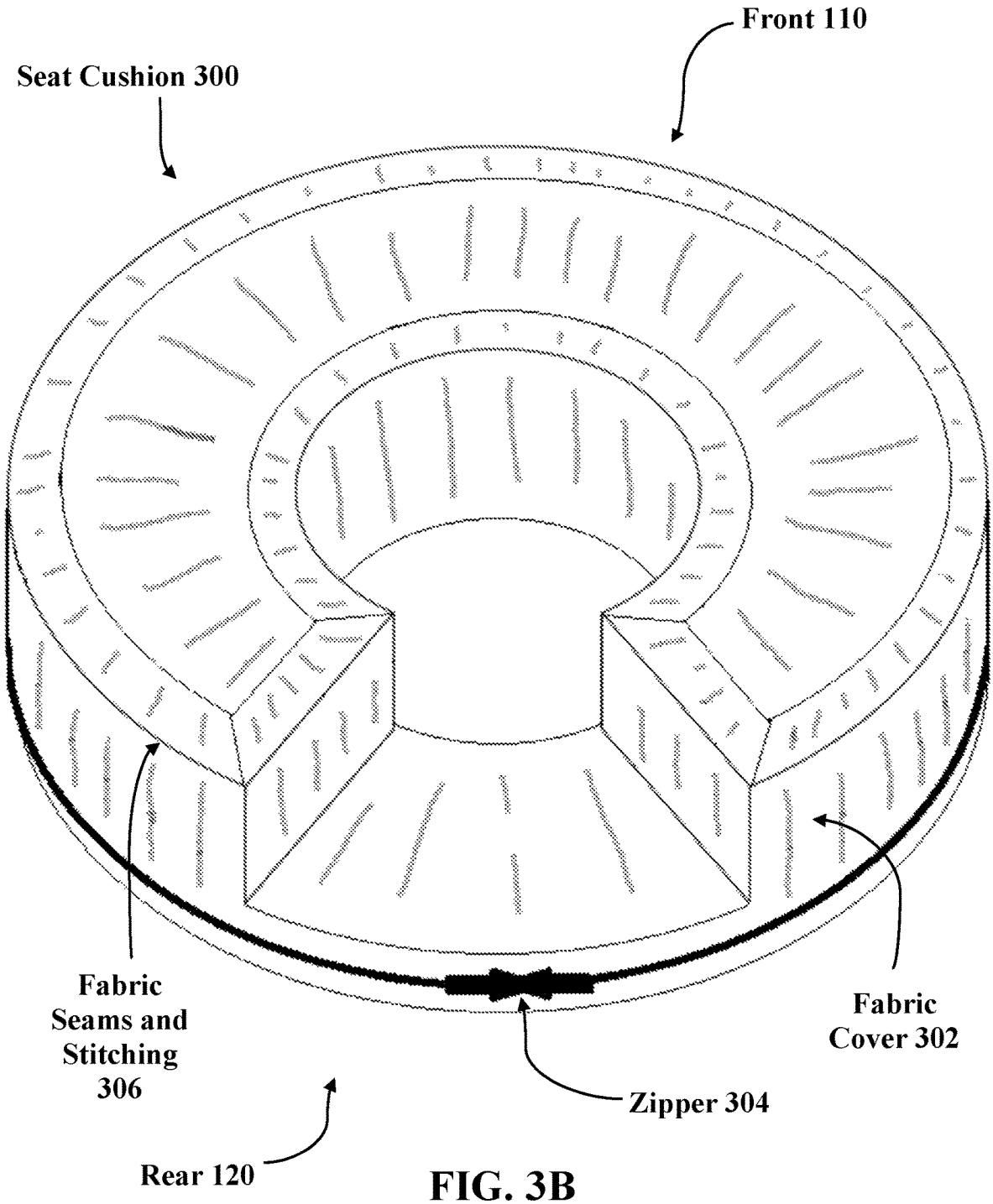

Referring to FIG. 3B, FIG. 3B depicts a top rear perspective view of a seat cushion 300, having a fabric cover 302 in an exemplary embodiment. The fabric cover 302 preferably is removable via a zipper 304 encircling at least part of the base section 330, as the widest part of the cushion 300. The fabric cover 302 preferably is contoured to the top section 310, the middle section 320, and the base section 330 using fabric seams and stitching 306 that follow the surface lines of the cushion 300. The fabric cover 302 may form an enclosure that resembles a Bundt cake, into which the cushion 300 may be placed after opening the zipper 304, followed by closing the zipper 304 for use of the cushion 300 by a user. The fabric cover 302 preferably is washable and replaceable, allowing washing and replacement when warranted.

Figures 4A, 4B:
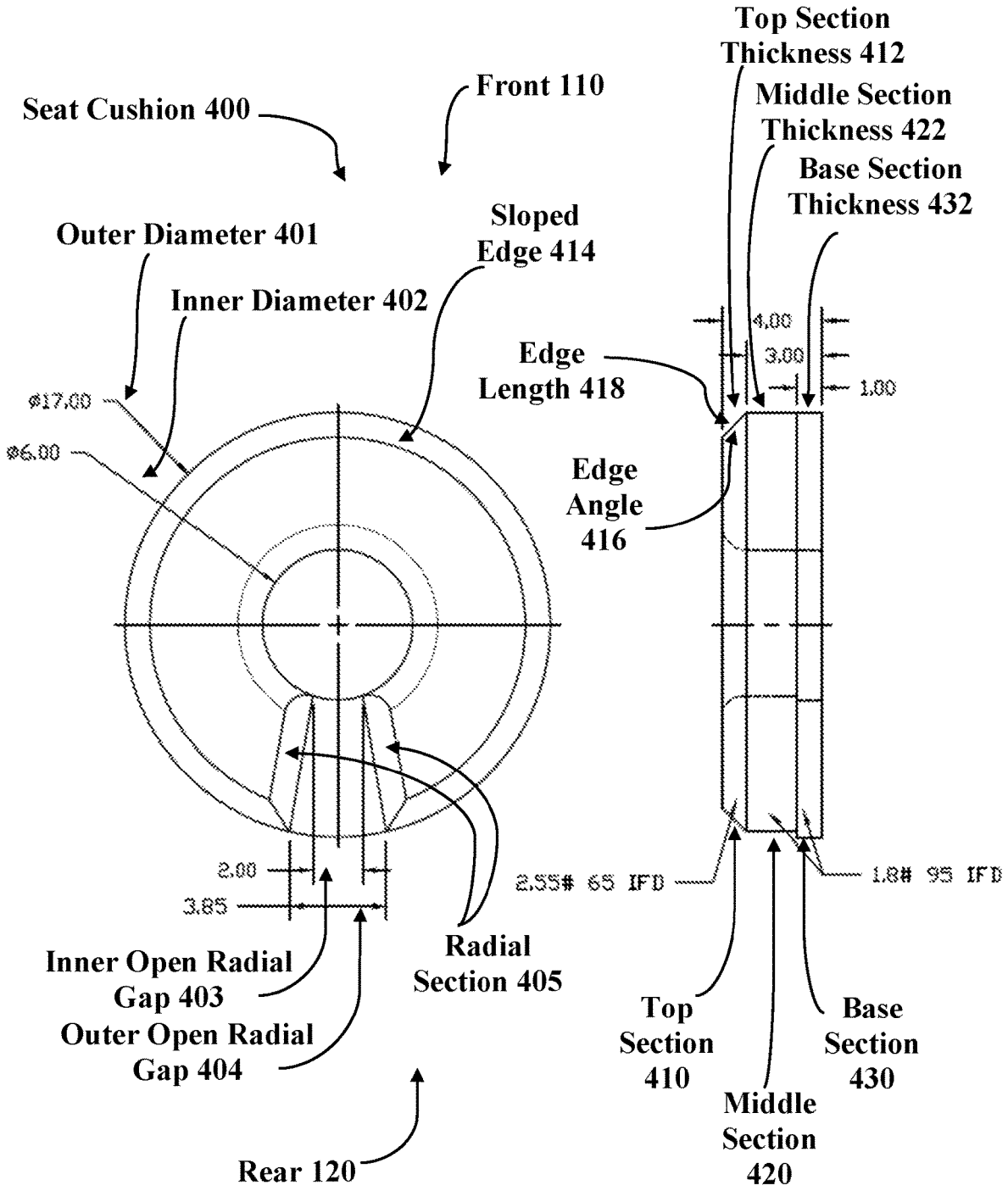
FIGS. 4A-4H depict pairs of top plan views and side elevation views of an exemplary embodiment of the seat cushion depicted in FIGS. 3A-3B.
Figures 4C, 4D:
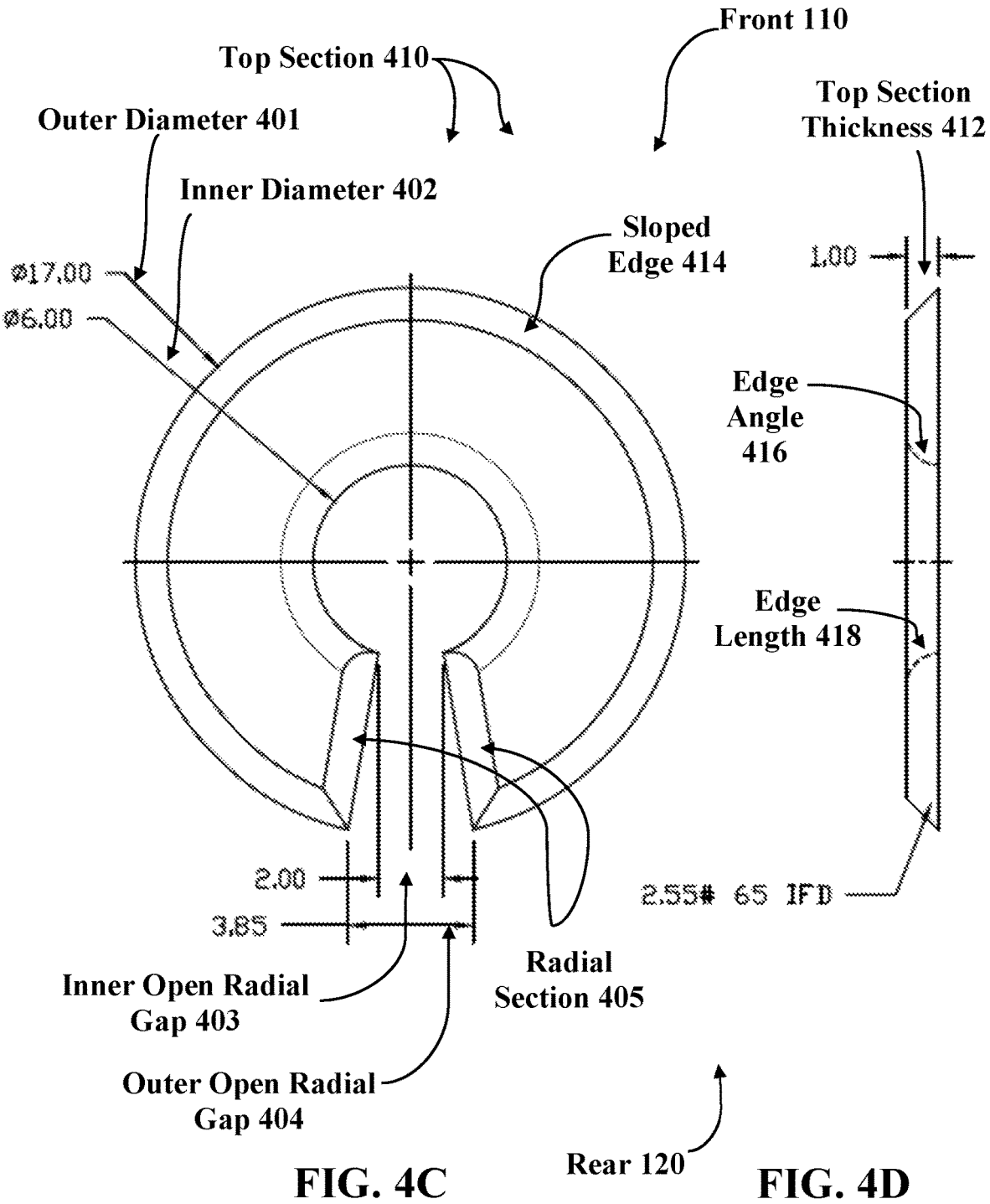
Figures 4E, 4F:
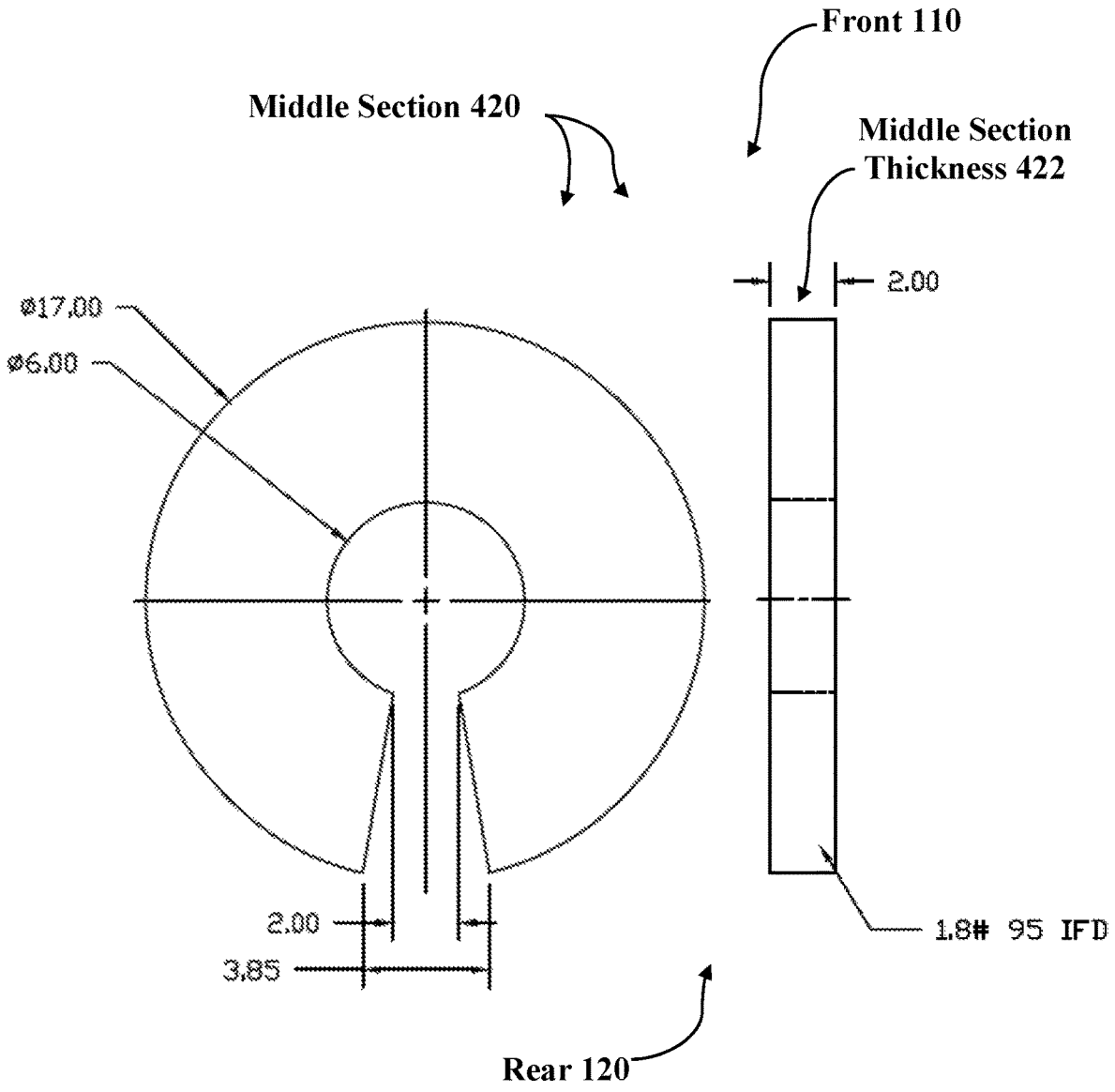
Figures 4G, 4H:
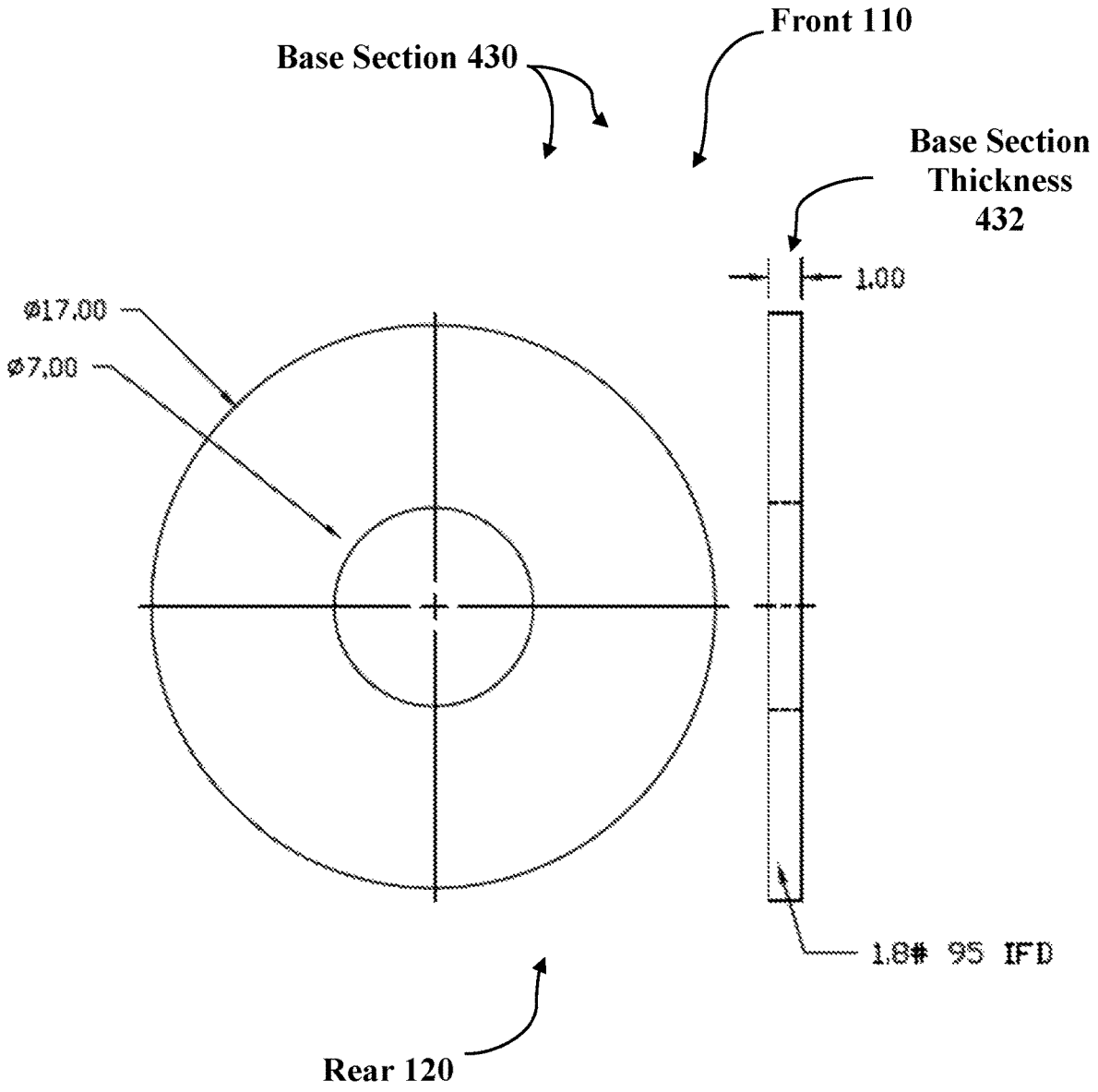

Referring to FIG. 4A to FIG. 4H, FIG. 4A to FIG. 4H depict pairs of top plan views and side elevation views of a seat cushion 400 as an exemplary embodiment of a seat cushion 300. FIGS. 4A-4B respectively depict a top plan view and a side elevation view of a fully-assembled seat cushion 400 comprising a top section 410, a middle section 420, and a base section 430. FIGS. 4C-4D respectively depict a top plan view and a side elevation view of the top section 410. FIGS. 4E-4F respectively depict a top plan view and a side elevation view of the middle section 420. FIGS. 4G-4H respectively depict a top plan view and a side elevation view of the base section 430. Although not depicted on cushion 400, cushion 400 could include a cover or liner, similar to fabric cover 302 for cushion 300.

Exemplary dimensions and exemplary material characteristics of a preferred embodiment are depicted as well. All exemplary dimensions and exemplary material characteristics are approximate within basic manufacturing parameters not requiring exactitude for a seat cushion. As depicted in FIGS. 4A-4B, an outer diameter 401 of the cushion 400 is depicted as being 17 inches, whereas an inner diameter 402 of the hollow space is depicted as being 6 inches. An inner open radial gap 403 is depicted as being 2 inches across, whereas an outer open radial gap 404 is depicted as being 3.85 inches across, spanned by two radial sections 405. The cushion 400 is depicted as having a cushion thickness of 4 inches, comprising a top section thickness 412 of 1 inch, a middle section thickness 422 of 2 inches, and a base section thickness 432 of 1 inch. The top section 410 is depicted as having a sloped edge 414 that is chamfered, beveled, rounded, and/or cut-cornered, around the outer diameter 401, around the inner diameter 402, and along the radial sections 405, with the sloped edge 414 having an edge angle 416 of about 45 degrees and an edge length 418 of approximately 1.414 inches (e.g., square root of 2, for a top section thickness of 1 inch). As depicted in FIGS. 4A-4B, the top section 410 may comprise a first foam material having a density and a stability support factor rating of 2.55 #65 IFD (IFD stands for Indentation Force Deflection), the middle section 420 may comprise a second foam material having a stability support factor rating of 1.8 #95 IFD, and the base section 430 may comprise a third foam material having a stability support factor rating of 1.8 #95 IFD. The exemplary dimensions and material characteristics of the cushion may be adjusted to accommodate different situations and users, such as larger dimensions for larger users (e.g., adults), small dimensions for smaller users (e.g., children, adolescents, and smaller adults), firmer characteristics for heavier users (e.g., heavy or overweight adults), and/or softer characteristics for lighter users (e.g., children, adolescents, and smaller adults).

Systems in accordance with aspects of the invention may include, for instance, a system for reducing and possibly preventing application of pressure from a seated person's body weight on the sacrococcygeal region, and possible pain associated with such application of pressure. An exemplary embodiment of the seat cushion in accordance with present invention may be incorporated into a system that may include the seat cushion and one or more aspects of the environment in which the seat cushion will be used. For instance, a system may include, for instance: a cover or liner shaped to match the partially-open annular ring; placement of the seat cushion within or attached to the supporting surface (e.g., attached to a chair, strapped to a stool using straps connected to a cover, within an upholstery of couch, or attached to a mattress of a hospital bed); and use of multiple seat cushions layered on top each other to increase a sitting height or account for additional body weight of a heavier seated person.

Methods in accordance with aspects of the invention may include, for instance, a method for reducing, and possibly preventing, application of pressure from a seated person's body weight on the sacrococcygeal region, and possible pain associated with such application of pressure, wherein the method includes providing and using a seat cushion apparatus adapted to avoid applying pressure on the sacrococcygeal region of the seated person, while still cushioning the seated person's buttocks and groin, in which the seat cushion is configured as a partially-open annular ring including a circular hollow space in a center of the ring, and a radial-arc-shaped opening in the ring forming a trapezium-shaped hollow space. The method further may comprise placing and positioning the seat cushion on supporting surface so as to align the sacrococcygeal region of the seated person above the trapezium-shaped hollow space at a rear of the seat cushion.

The foregoing description discloses exemplary embodiments of the invention. While the invention herein disclosed has been described by means of specific embodiments and applications thereof, numerous modifications and variations could be made thereto by those skilled in the art without departing from the scope of the invention set forth in the claims. Modifications of the above disclosed apparatus and methods that fall within the scope of the claimed invention will be readily apparent to those of ordinary skill in the art. As such, other embodiments may fall within the spirit and scope of the claimed invention, as defined by the claims that follow hereafter.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the claims.

In the description above, numerous specific details are set forth in order to provide a more thorough understanding of embodiments of the invention. It will be apparent, however, to an artisan of ordinary skill that the invention may be practiced without incorporating all aspects of the specific details described herein. Not all possible embodiments of the invention are set forth verbatim herein. A multitude of combinations of aspects of the invention may be formed to create varying embodiments that fall within the scope of the claims hereafter. In addition, specific details well known to those of ordinary skill in the art have not been described in detail so as not to obscure the invention. Readers should note that although examples of the invention are set forth herein, the claims, and the full scope of any equivalents, are what define the metes and bounds of the invention protection.

What is claimed is:

1. An apparatus for reducing pressure applied to a sacrococcygeal region of a seated person, the apparatus comprising:

a seat cushion, adapted to avoid applying pressure to the sacrococcygeal region of the seated person;

wherein the seat cushion comprises:

a partially-open annular ring of cushioning material that defines a hollow circular space in a center of the ring and a hollow space along a radial arc portion missing from a rear of the ring, the partially-open annular comprising an open annular partial ring top section and an open annular partial ring middle section, the middle section being attached to and below the top section;

a closed annular ring base section, the base section being attached to and below the middle section; and a cover or liner shaped to match the partially-open annular ring;

wherein the top section has a sloped edge opposite the middle section and continuing around an outer diameter, an inner diameter, and radial sections adjacent the hollow space along the radial arc portion;

wherein the hollow circular space connects to the hollow space along the radial arc portion of the ring; and, wherein the seat cushion is adapted to be positioned under the seated person with the hollow circular space underneath the seated person's perineum, and with the hollow space along the radial arc portion underneath the seated person's sacrococcygeal region.

2. The apparatus according to claim 1, wherein:

the hollow space along the radial arc portion is configured in a shape of a trapezium and comprises a trapezium-shaped hollow space.

3. The apparatus according to claim 2, wherein:

the cushioning material comprises resiliently flexible, deformable material;

the top section comprises a first material;

the middle section comprises a second material;

the base section comprises a third material; and the first material has a lower support factor than the second material or the third material.

4. The apparatus according to claim 3, wherein:

the cushioning material is selected from a group consisting of sponge, soft foam, resilient fibers, and resilient rubber.

5. The apparatus according to claim 1, wherein:

the ring has an outer diameter of between 15 and 19 inches and an inner diameter of between 4 and 8 inches.

6. The apparatus according to claim 5, wherein:

the ring has an outer diameter of 17 inches and an inner diameter of between 6 inches.

7. The apparatus according to claim 1, wherein:

the cover or liner is removable and washable.

8. The apparatus according to claim 7, wherein:

the cushioning material is removable and washable.

9. The apparatus according to claim 1, wherein:

the seat cushion is attached to a supporting surface by the cover.

10. A system for reducing pressure applied to a sacrococcygeal region of a seated person, the system comprising:

a supporting surface, adapted to support the seated person, the seated person having a body weight within a range of body weights for which the supporting surface is adapted; and a seat cushion, adapted to avoid applying pressure to the sacrococcygeal region of the seated person;

wherein the seat cushion comprises:

a partially-open annular ring of cushioning material that defines a hollow circular space in a center of the ring and a hollow space along a radial arc portion missing from a rear of the ring, the partially-open annular comprising an open annular partial ring top section and an open annular partial ring middle section, the middle section being attached to and below the top section;

a closed annular ring base section, the base section being attached to and below the middle section; and a cover or liner shaped to match the partially-open annular ring;

wherein the top section has a sloped edge opposite the middle section and continuing around an outer diameter, an inner diameter, and radial sections adjacent the hollow space along the radial arc portion;

wherein the hollow circular space connects to the hollow space along the radial arc portion of the ring; and, wherein the seat cushion is adapted to be positioned under the seated person with the hollow circular space underneath the seated person's perineum, and with the hollow space along the radial arc portion underneath the seated person's sacrococcygeal region.

11. The system according to claim 10, wherein:

the hollow space along the radial arc portion is configured in a shape of a trapezium and comprises a trapezium-shaped hollow space.

12. The system according to claim 11, wherein:

the cushioning material comprises resiliently flexible, deformable material;

the top section comprises a first material;

the middle section comprises a second material;

the base section comprises a third material; and the first material has a lower support factor than the second material or the third material.

13. The system according to claim 12, wherein:

the cushioning material is selected from a group consisting of sponge, soft foam, resilient fibers, and resilient rubber.

14. The system according to claim 10, wherein:

the ring has an outer diameter of between 15 and 19 inches and an inner diameter of between 4 and 8 inches.

15. The system according to claim 14, wherein:

the ring has an outer diameter of 17 inches and an inner diameter of between 6 inches.

16. The system according to claim 10, wherein:

the cover or liner is removable and washable; and, the cushioning material is removable and washable.

17. A method for reducing pressure applied to a sacrococcygeal region of a seated person, the method comprising:

providing a seat cushion, adapted to avoid applying pressure to the sacrococcygeal region of the seated person;

positioning the seat cushion under the seated person to support and cushion the seated person's buttocks and groin, while avoiding applying pressure to the sacrococcygeal region of the seated person; and, using the seat cushion as positioned;

wherein the seat cushion comprises:

a partially-open annular ring of cushioning material that defines a hollow circular space in a center of the ring and a hollow space along a radial arc portion missing from a rear of the ring, the partially-open annular comprising an open annular partial ring top section and an open annular partial ring middle section, the middle section being attached to and below the top section;

a closed annular ring base section, the base section being attached to and below the middle section; and a cover or liner shaped to match the partially-open annular ring;

wherein the top section has a sloped edge opposite the middle section and continuing around an outer diameter, an inner diameter, and radial sections adjacent the hollow space along the radial arc portion;

wherein the hollow circular space connects to the hollow space along the radial arc portion of the ring; and, wherein the seat cushion is adapted to be positioned under the seated person with the hollow circular space underneath the seated person's perineum, and with the hollow space along the radial arc portion underneath the seated person's sacrococcygeal region.

18. The method according to claim 17, further comprising:

providing a supporting surface, adapted to support the seated person, the seated person having a body weight within a range of body weights for which the supporting surface is adapted; and positioning the seat cushion on the supporting surface such that the seat cushion is positioned under the seated person to support and cushion the seated person's buttocks and groin, while avoiding applying pressure to the sacrococcygeal region of the seated person.

19. The method according to claim 17, wherein:

the cover or liner is removable and washable.

20. The method according to claim 17, wherein:

the seat cushion is attached to a supporting surface by the cover.

* * * * *